United States Patent [19]

Ikeda et al.

[11] 4,347,420

[45] Aug. 31, 1982

[54] MICROWAVE SEAL STRUCTURE IN MICROWAVE OVEN

[75] Inventors: Nobuo Ikeda, Nara; Junzo Tanaka, Fujiidera; Hirofumi Yoshimura, Nara, all of Japan

[73] Assignee: Matsushita Electric Industrial Co., Ltd., Osaka, Japan

[21] Appl. No.: 158,229

[22] Filed: Jun. 10, 1980

[30] Foreign Application Priority Data

Sep. 11, 1979 [JP] Japan ..... 54-117113

[51] Int. Cl.[3] ..... H05B 6/76

[52] U.S. Cl. ..... 219/10.55 D; 174/35 GC

[58] Field of Search ..... 219/10.55 D, 10.55 F, 219/10.55 R; 174/35 R, 35 GC, 35 M

[56] References Cited

U.S. PATENT DOCUMENTS

| | | | |
|---|---|---|---|
| 2,772,402 | 11/1956 | Tomiyasu . | |
| 2,850,706 | 9/1958 | Gabriel . | |
| 3,629,537 | 12/1971 | Haagensen | 219/10.55 D |
| 3,651,300 | 3/1972 | Haagensen | 219/10.55 D |
| 3,767,884 | 10/1973 | Osepchuk et al. | 219/10.55 D |
| 3,809,843 | 5/1974 | Takayama | 219/10.55 D |
| 3,835,283 | 9/1974 | Suzuki | 219/10.55 D |
| 3,846,608 | 11/1974 | Valles | 219/10.55 D |
| 4,053,731 | 10/1977 | Foerstner | 219/10.55 D |
| 4,254,318 | 3/1981 | Ohkawa et al. | 219/10.55 D |

FOREIGN PATENT DOCUMENTS 1022103 3/1966 United Kingdom .

*Primary Examiner*—Arthur T. Grimley

*Attorney, Agent, or Firm*—Spencer & Kaye

[57] ABSTRACT

An improved choke seal arrangement, in a microwave oven, in which a slit structure is provided to prevent leakage of microwave energy around the periphery of the door. The slit structure, which has been provided in one of the walls defining the choke cavity in the prior art choke seal arrangement, is provided in a door wall portion spaced apart from the choke cavity so as to facilitate mechanical formation of the choke cavity and also to prevent deformation of the choke cavity wall during use. The choke seal arrangement permits the gap between the wall of the choke cavity and the confronting inner wall of the heating chamber to be smaller than hitherto, and the microwave seal performance further improved.

10 Claims, 9 Drawing Figures

MICROWAVE LEAKAGE mW/cm²
20
10
7
5
4
3
2
1
40
42
44

11
12
13
G
SLIT
PROBE

13
SLIT
METAL WALL
PROBE 12
13
G
SLIT
λ/4
METAL WALL
PROBE

MICROWAVE SEAL STRUCTURE IN MICROWAVE OVEN

BACKGROUND OF THE INVENTION

This invention relates to a microwave seal structure in a microwave heating apparatus such as a microwave oven for preventing leakage of the microwave energy through the gap between the door and the heating chamber of the microwave heating apparatus, and more particularly to improvements in the door seal structure in a microwave heating apparatus of a type in which an electric heater is provided in combination with a microwave generator.

A known microwave heating apparatus of the type provided with an electric heater in combination with its microwve generator is also capable of performing the function of pyrolitic self-cleaning. In such a microwave heating apparatus, the internal temperature of the heating chamber is generally raised to about 500° C. during self-cleaning, and therefore, the door is generally provided with a thickness that is considerably greater than an ordinary oven door due to the requirement for better heat insulation capability of the door.

In a microwave heating apparatus of the kind described above, a microwave seal structure having a choke arrangement with a configuration such that it can be received in the heating chamber in the closed position of the door is most frequently used in practice so that the microwave seal structure can be well matched to the thick door of the microwave heating apparatus. Further, in order to improve the microwave seal performance of the seal structure in a microwave heating apparatus of the kind described above, a plurality of slits are provided in the wall portion extending towards the inlet of the choke cavity among the wall portions defining the choke cavity. Such an arrangement is disclosed, for example, in U.S. Pat. No. 3,767,884 to Osepchuk et al., issued Oct. 23, 1973. The disclosure of this patent is incorporated by reference herein and reference is to be made thereto for details of the prior art construction. It is well known that the size of the gap between this slitted wall of the choke cavity and the corresponding portion of the walls defining the heating chamber exerts a great influence on the microwave seal performance of the choke and is desirably as small as possible from the viewpoint of microwave seal performance. However, it is difficult to maintain the surface flatness of the wall of the choke cavity formed with the slits, because this wall is finely divided by the slits. A temperature as high as about 800° C. is generally applied to the walls when the walls are subjected to a finishing treatment such as finishing with enamel. Since the slitted wall of the choke cavity will be greatly deformed in such a case, the slitted wall of the choke cavity may finally make contact with the opposite wall portion of the heating chamber unless the gap therebetween is designed to be much larger than when the wall of the choke cavity is not provided with any slits. However, provision of a very large gap between the slitted wall of the choke cavity and the opposite wall portion of the heating chamber has inevitably resulted in an objectionable increase in the amount of leakage of the microwave energy, as pointed out hereinbefore.

It is therefore a primary object of the present invention to provide an improved door seal structure which obviates the aforementioned defects of the prior art structure in both quality and performance in spite of the fact that it is quite simple in construction.

SUMMARY OF THE INVENTION

In accordance with one aspect of the present invention, there is provided a microwave heating apparatus comprising a heating chamber having an access opening, means for generating microwave energy and guiding the microwave energy toward and into the heating chamber, and door means for openably closing the access opening of the heating chamber. The door means is provided with a choke arrangement configured to be received in the heating chamber in the closed position of the door means and a plurality of slits formed in a door wall portion which is disposed opposite a front wall of the heating chamber surrounding the access opening and which is located at the outside and far side of the choke arrangement when viewed from the interior of the heating chamber. There is no metal wall within a distance of about $\lambda/4$ (where $\lambda$ is the wavelength of the microwave energy used for heating) behind the slitted door wall portion when viewed from the front wall of the heating chamber.

In accordance with another aspect of the present invention, there is provided a microwave heating apparatus comprising a heating chamber having an access opening, means for generating microwave energy and guiding the microwave energy toward and into the heating chamber, and door means for openably closing the access opening of the heating chamber. The door means is provided with a choke arrangement configured to be received in the heating chamber in the closed position of the door means, a plurality of slits formed in a door wall portion which is disposed opposite a front wall of the heating chamber surrounding the access opening and which is located at the outside and far side of the choke arrangement when viewed from the interior of the heating chamber, and cavity means formed behind the slitted door wall portion when viewed from the front wall of the heating chamber and having a substantially U-like sectional shape with a depth of about $\lambda/4$, where $\lambda$ is the wavelength of the energy microwave used for heating.

BRIEF DESCRIPTION OF THE DRAWINGS

Other objects, features and advantages of the present invention will become apparent from the following description taken in conjunction with the accompanying drawings, in which.

BRIEF DESCRIPTION OF THE PREFERRED EMBODIMENT

Preferred embodiments of the present invention will now be described with reference to the accompanying drawings.

Figure 1:
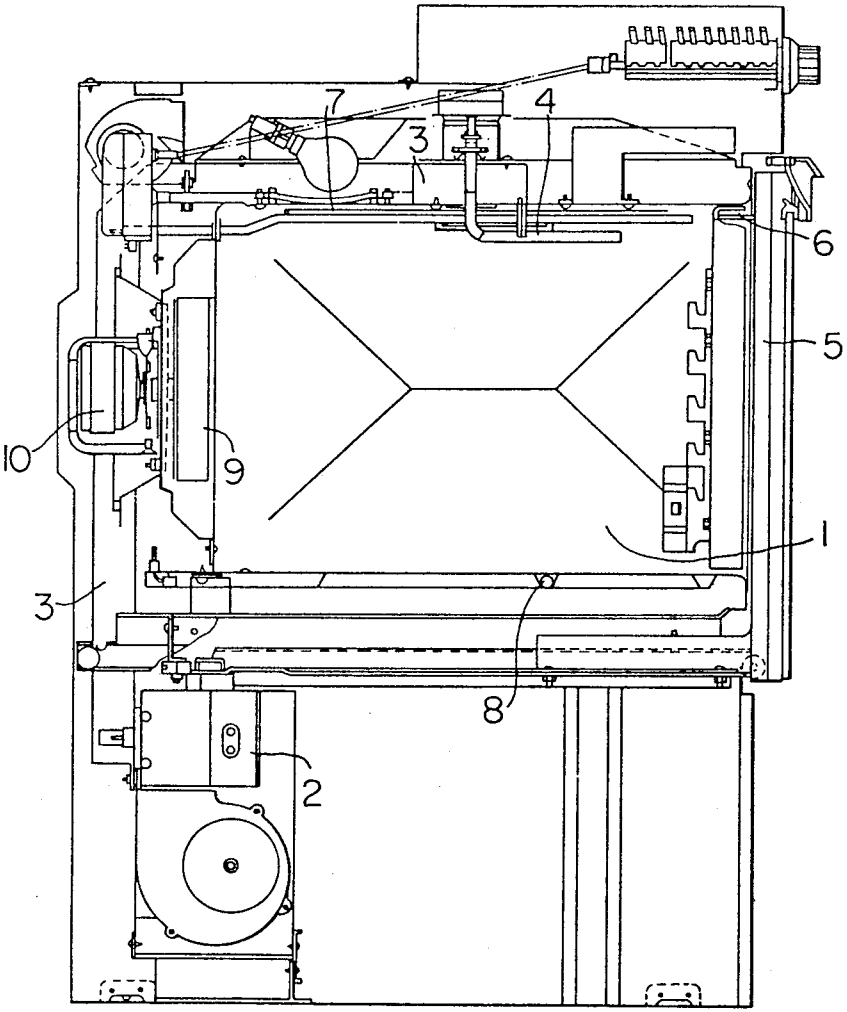
FIG. 1 is a general view showing schematically the structure of a microwave oven incorporating the present invention.

Referring to FIG. 1 which is a schematic general view of a microwave oven to which the present invention is applied, microwave energy generated by microwave oscillator or magnetion 2 is guided by a waveguide 3 toward a heating chamber 1 and radiated in the heating chamber by a rotating antenna 4 mounted in an upper central portion of the heating chamber 1. An access opening of the heating chamber 1 is openably closed by a door 5, and the door 5 is provided with a choke arrangement 6 around its periphery which is configured to be received in the heating chamber 1 when the door 5 is closed. The microwave oven includes electric heaters 7 and 8, a hot air circulating fan 9, and a motor 10 driving the fan 9.

Figure 2:
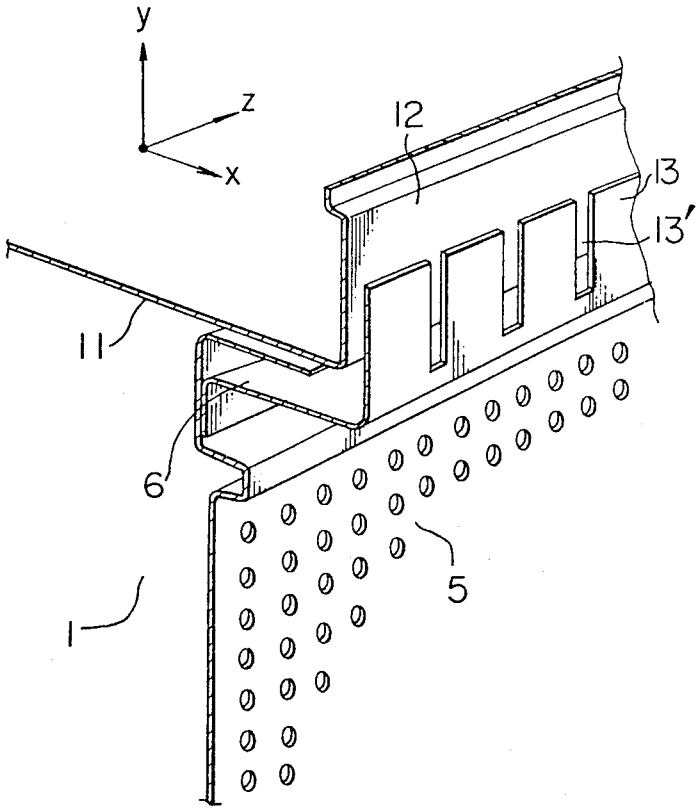
FIG. 2 is an enlarged schematic perspective view showing part of an embodiment of the door seal structure according to the present invention.

FIG. 2 shows schematically part of an embodiment of the door seal structure according to the present invention in an enlarged perspective fashion. Referring to FIG. 2, the walls defining the heating chamber 1 includes an inner wall 11 and a front wall 12 extending from the front end of the inner wall 11 and surrounding the access opening of the heating chamber 1. It will be seen in FIG. 2 that the choke arrangement 6 provided in the door 5 is received in the heating chamber 1 in the closed position of the door 5. The depth between the open end and the closed bottom of the choke cavity is selected to be about $\lambda/4$ (where $\lambda$ is the wavelength of the microwave energy used for heating). A plurality of slits 13' having a depth of about $\lambda/4$ and spaced apart by a predetermined pitch are formed in a door wall portion 13 which has a surface disposed opposite the front wall 12 of the heating chamber 1 and which is located at the outside and far side of the choke arrangement 6 when viewed from the interior of the heating chamber 1.

The choke cavity having a depth of about $\lambda/4$ acts to block propagation of microwave energy in the x and y directions in FIG. 2, while the slits 13' spaced apart by the predetermined pitch act to block propagation of microwave energy in the z direction. The slit structure according to the present invention is characterized by the fact that the slits 13' are formed in the door wall portion 13 in a relation which is entirely independent of the choke arrangement 6 and are located at the outside and far side of the choke arrangement 6 when viewed from the interior of the heating chamber 1. In the case of the prior art slit structure, similar slits are provided in the portion of the walls defining the choke cavity. In the slit structure according to the present invention, because no slits are formed in any one of the walls defining the choke cavity, the wall of the choke cavity opposite the inner wall 12 of the heating chamber 1 can maintain the desired surface flatness, and the choke seal performance of the choke arrangement 6 is not impaired by the slits 13' in any way.

Although it is also difficult to maintain the surface flatness of the slitted door wall portion 13 as in the case of the prior art slit structure, such insufficient surface flatness will not so adversely affect the microwave seal performance required for the choke arrangement of the present invention as occurs when the slitted wall is entirely independent of the choke arrangement.

Figure 3:
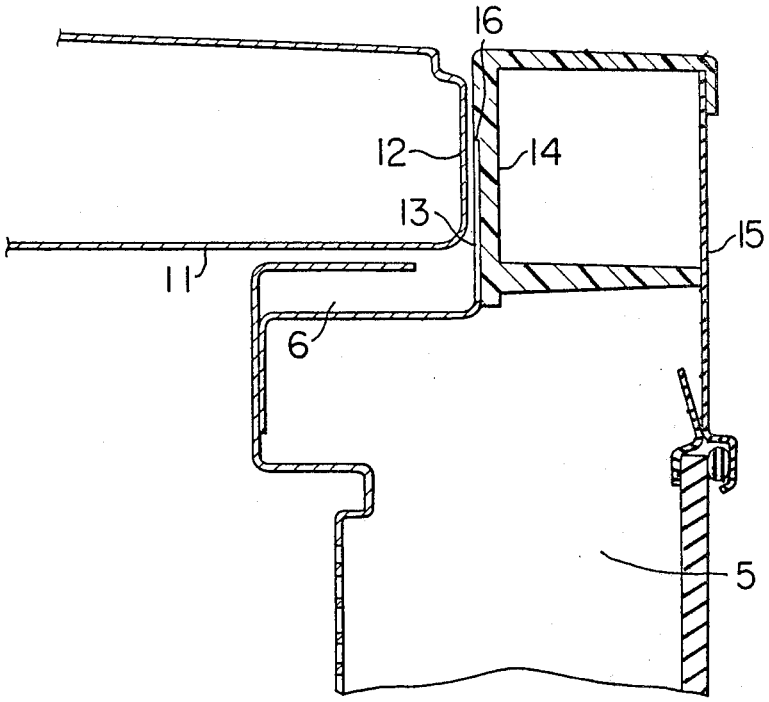
FIG. 3 is an enlarged schematic sectional view showing part of another embodiment of the door seal structure according to the present invention.

FIG. 3 shows another embodiment of the door seal structure according to the present invention. Referring to FIG. 3, an inner panel 14 made of a nonmetallic material such as a porcelain or resin is interposed between the slitted door wall portion 13 and a door front panel 15 made of a metallic material. The slitted door wall portion 13 is spaced apart from the door front panel 15 by a distance larger than about $\lambda/4$, for the reason described below. When a metal wall is present immediately behind the slitted door wall portion 13 when viewed from the front wall 12 of the heating chamber, formation of an electrostatic capacitance between the slitted door wall portion 13 and the metal wall will lead to a destruction of the condition of the opening between the end edge 16 of the slit structure and the front wall 12 of the heating chamber 1, resulting in an abrupt increase in the amount of microwave leakage. A distance larger than about $\lambda/4$ is provided between the slitted door wall portion 13 and the door front panel 15 to avoid such difficulty.

Figure 4:
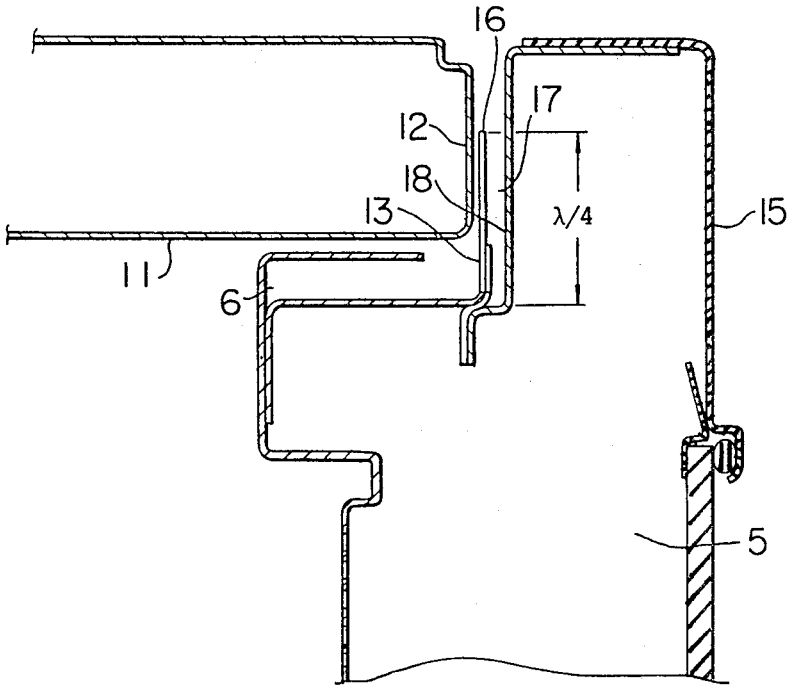
FIG. 4 is an enlarged schematic sectional view showing part of still another embodiment of the door seal structure according to the present invention.

In another embodiment shown in FIG. 4, a metal wall 18 is disposed on the outside of the slitted door wall portion 13 in a spaced apart relationship. The wall 18 is separated by a distance of about 3 mm from the slitted door wall portion 13. This metal wall 18 and the slitted door wall portion 13 cooperates to form a channel or cavity 17 of substantially U-like sectional shape having a depth of about $\lambda/4$. By selecting the depth of the cavity 17 to be about $\lambda/4$, the condition of opening is forcedly established between the end edge 16 of the slit structure and the metal wall 18 so that the door seal structure is equivalent to that in which such a metal wall 18 is not provided. Consequently the metal wall 18 does not have a substantially adverse effect on the microwave seal performance.

Figure 6:
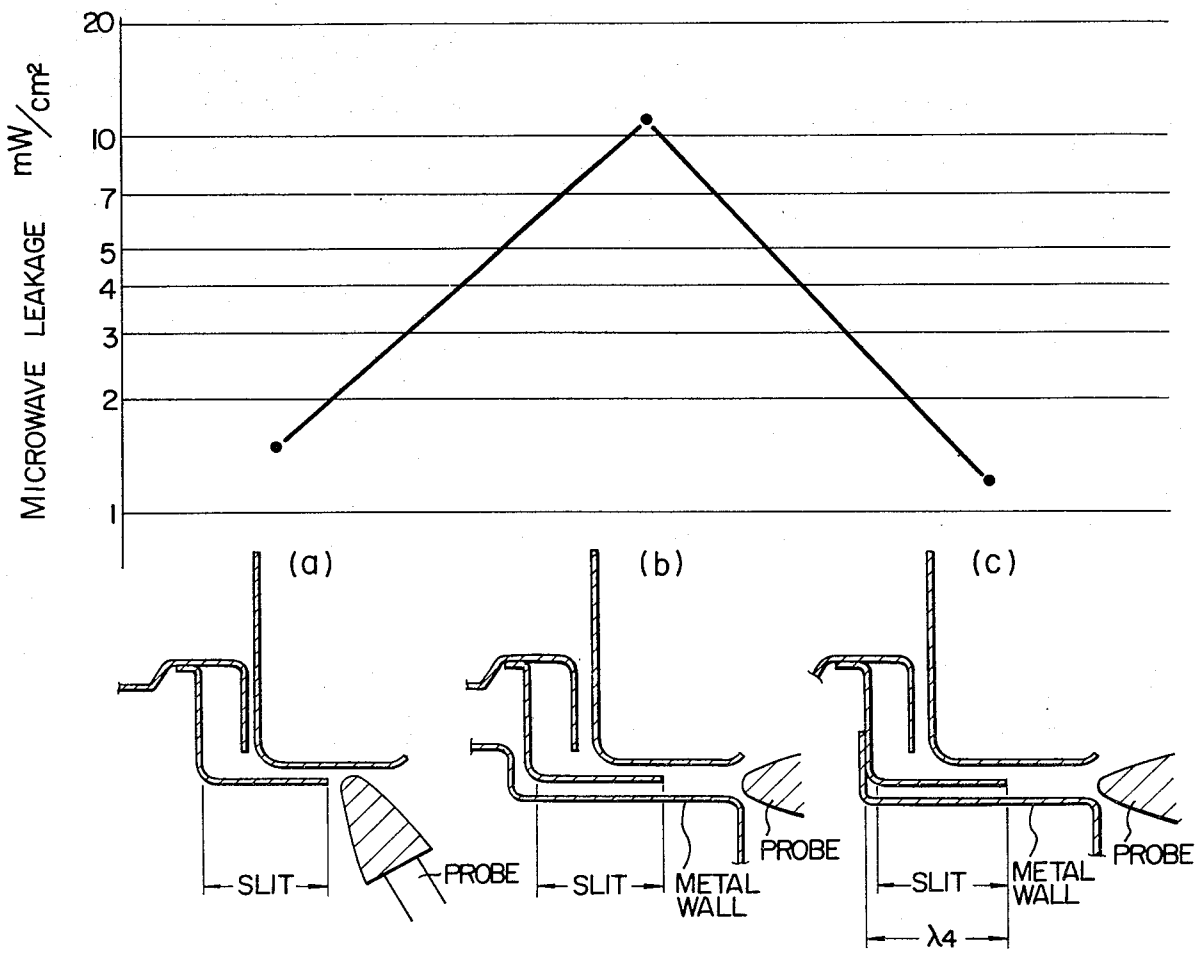
FIG. 6A is a graph showing the results of a microwave leakage test on various forms of the door seal structure and FIGS. 6B, 6C and 6D are schematic diagrams showing three door seal structures.
Figures 6A, 6B, 6C, 6D:
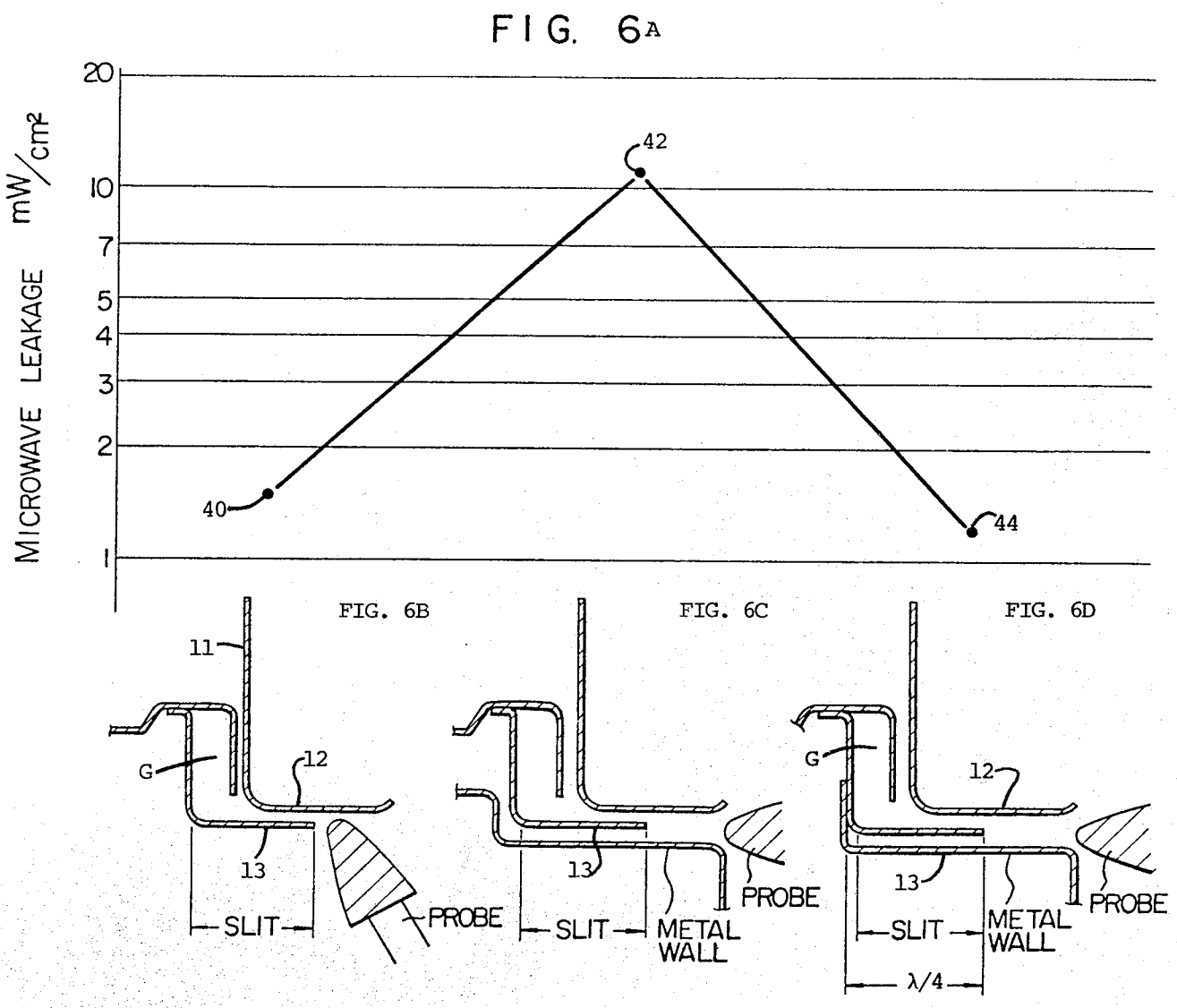

FIG. 6A shows the results of tests conducted by the inventors using a microwave probe. Point 40 shows the measured microwave energy leakage in milliwatts per square centimeter from an oven having the construction shown in FIG. 3 and in the partial schematic diagram of FIG. 6B. As shown, energy leaking from the opening between the front wall 12 and slitted door wall portion 13 was between 1 and 2 $mw/cm^2$.

The leakage measured by a probe placed as shown in the structure schematically illustrated in FIG. 6B is indicated at point 42 of FIG. 6A. In FIG. 6C, which does not employ the present invention and in which a metal wall is provided immediately behind the slitted door wall 13, the measured leakage was over 10 $mW/cm^2$ as shown at point 42 of FIG. 6A.

FIG. 6D illustrates schematically the configuration of FIG. 4 in which a metal wall 18 is provided immediately behind the slitted door wall portion 13 so as to form a cavity 17 defined by the metal wall 18 and the wall 13. The microwave energy leakage using this structure is shown at point 44 in FIG. 6A.

As seen from the results of the tests plotted on the broken line curve defined by points 40, 42 and 44, the amount of microwave energy leakage from the embodiment of the invention shown in FIG. 6D is at substantially the same level as that measured from the embodiment of the invention illustrated in FIG. 6B. That is, the embodiment of FIG. 6D in which a metal wall 18 is provided immediately behind the slitted door wall portion 13 so as to form a cavity 17 permits about the same amount of microwave energy leakage as the embodiment of FIG. 6B in which no metal wall is provided behind the slitted door wall portion 13. In contrast, the unsatisfactory structure shown in FIG. 6C, in which a metal wall is provided immediately behind the slitted door wall portion without forming a cavity, results in a measured microwave leakage of about five to ten times that measured with the embodiments of the invention shown in FIGS. 6B and 6D.

Figure 5:
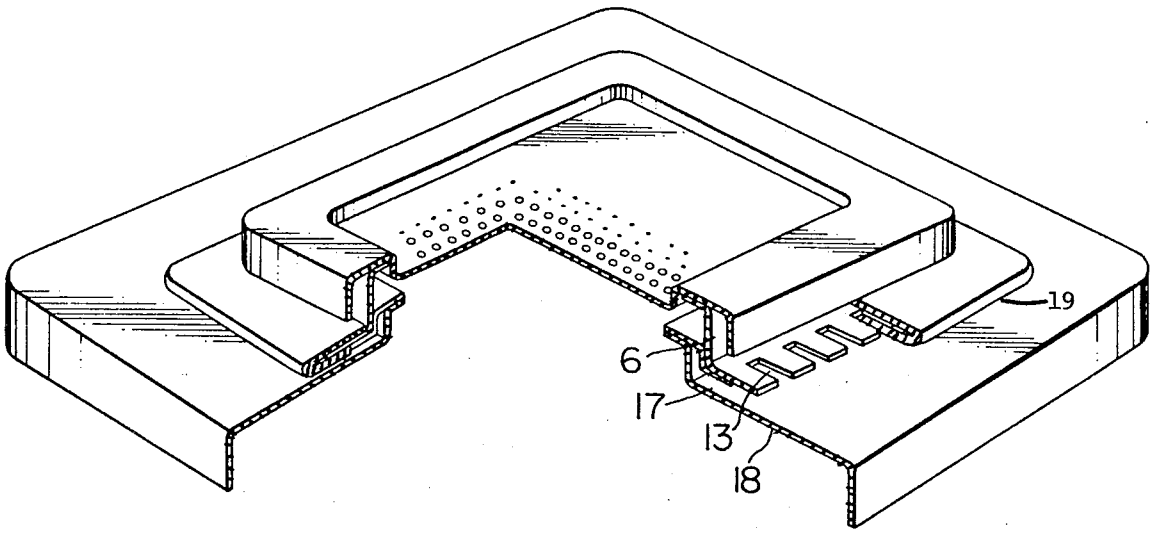
FIG. 5 is an enlarged schematic, partly-cutaway perspective view showing a further embodiment of the door seal structure according to the present invention.

In the mebodiment shown in FIG. 5, the slitted door wall portion 13 is covered with a heat-resisting dielectric material 19 such as a glass cloth. Provision of such a covering is advantageous in that leakage of heat from the heating chamber 1 can also be prevented, and the slits 13' are concealed from view thereby providing a smart external appearance of that part of the microwave oven. In addition the dielectric covering 19 acts also as a shock absorber which absorbs the shock imparted when the door 5 is closed.

Although not specifically illustrated in the drawings, the slitted door wall portion 13 may be made of a metal having elasticity. Employment of such an elastic metal is advantageous in that the shock imparted during closing of the door 5 can be absorbed, and a shock absorbing material or a spacer need not be especially interposed between the door 5 and the front wall 12 of the heating chamber 1.

It will be understood from the foregoing description that the present invention provides an improved door seal structure of simple construction which obviates the manufacturing difficulty and insufficient seal performance of the prior art door seal structure and which is excellent in both quality and seal performance.

What is claimed is:

1. A microwave heating apparatus comprising:

a heating chamber having an access opening, an inner wall and a front wall;

means for generating microwave energy and for guiding said energy into said heating chamber;

a door for openably closing the access opening of said heating chamber;

a choke secured about the periphery of said door, said choke being received within said heating chamber when said door is in its closed position and spaced from the inner wall of said chamber to provide a gap therebetween, said choke inhibiting microwave energy from leaking from said heating chamber through said gap to the outside of said apparatus when said door is in its closed position;

a wall portion of said door attached to said choke and extending outside said heating chamber with one surface facing the front wall portion thereof when said door is in its closed position, said wall portion having a plurality of slits spaced around the access opening of said door and extending in a direction substantially normal to the edge of said access opening with the tops ends thereof facing the outside of said apparatus; and means for maintaining the top ends of said slits substantially electrically open to the outside of said apparatus with respect to microwave energy leaking from within said heating chamber when said door is in its closed position.

2. A microwave heating apparatus as claimed in claim 1, which further comprises a metal front panel secured to said door at a distance from said slitted wall portion which is greater than $\lambda/4$, where $\lambda$ is the wavelength of the energy generated by said means for generating microwave energy.

3. A microwave heating apparatus as claimed in claim 2, which further comprises an inner panel made of a non-metallic material interposed between said metal front panel and said slitted wall portion.

4. A microwave heating apparatus as claimed in claim 3, wherein said non-metallic material is a resin material.

5. A microwave heating apparatus as claimed in claim 3, wherein said non-metallic material is a glass.

6. A microwave heating apparatus as claimed in claim 1 which further comprises a metal wall secured to the other surface of said wall portion and spaced therefrom, the space between said metal wall and wall portion forming channel having a substantially U-shaped cross-section with a depth of about $\lambda/4$, where $\lambda$ is the wavelength of the energy generated by said means for generating microwave energy.

7. A microwave heating apparatus as claimed in claim 1, 4, 5, 2, 3 or 6, wherein said slitted door wall portion is covered with a heat-resisting dielectric material.

8. A microwave heating apparatus as claimed in claim 1, 4, 5, 2, 3 or 6, wherein said slitted door wall portion is made of a metal material having elasticity.

9. A microwave heating apparatus as claimed in claim 7, wherein said heat-resisting dielectric material is a glass cloth.

10. A microwave heating apparatus as claimed in claim 7 wherein said slitted door wall portion is made of a metal material having elasticity.

* * * * *